US006749522B1

(12) United States Patent
Aikman

(10) Patent No.: US 6,749,522 B1
(45) Date of Patent: Jun. 15, 2004

(54) GOLF BALL RETRIEVAL DEVICE

(76) Inventor: Richard Allen Aikman, 206 Palo Verde, Kerrville, TX (US) 78028

( * ) Notice: Subject to any disclaimer, the term of this patent is extended or adjusted under 35 U.S.C. 154(b) by 0 days.

(21) Appl. No.: 10/385,318

(22) Filed: Mar. 10, 2003

Related U.S. Application Data

(60) Provisional application No. 60/319,416, filed on Jul. 22, 2002.

(51) Int. Cl.[7] ..... A63B 57/00
(52) U.S. Cl. ..... 473/286; 294/19.2
(58) Field of Search ..... 473/286, 285, 473/284, 283, 282; 294/19.2

(56) References Cited

U.S. PATENT DOCUMENTS 6,516,982 B1 * 2/2003 Childers ..... 224/197
2003/0216190 A1 * 11/2003 Wang ..... 473/286

FOREIGN PATENT DOCUMENTS

JP 9-122282 * 5/1997

* cited by examiner

*Primary Examiner*—Stephen Blau
(74) *Attorney, Agent, or Firm*—Wayne J. Colton, Inc.

(57) ABSTRACT

A golf ball retrieval device includes an attachment pin, for mating with the end of a golf club grip, and a holder adapted to be removably dependently attached to the attached pin. The holder is generally formed in the shape of hollow hemisphere and is manufactured from a polycarbonate or like material in order to enable a slight spreading of two wings formed in the holder between two troughs in the sides of the holder. The holder is thus adapted to apply a slight gripping force about a golf ball inserted into the holder.

10 Claims, 2 Drawing Sheets

GOLF BALL RETRIEVAL DEVICE

RELATED APPLICATION

This application claims all available benefit, under 35 U.S.C. §119(e), to U.S. provisional patent application Serial No. 60/319,416 filed Jul. 22, 2002. By this reference, the full disclosure of U.S. provisional patent application Serial No. 60/319,416 is incorporated herein as though now set forth in its entirety.

FIELD OF THE INVENTION

The present invention relates to golf. More particularly, the invention relates to an apparatus for conveniently retrieving from a putting cup a golf ball.

BACKGROUND OF THE INVENTION

The game of golf is popularly enjoyed the world around by enthusiasts of all ages. Unfortunately, the elderly or those having various disabilities are unable to fully enjoy the game when it becomes difficult to bend down below ground level to retrieve a golf ball from a putting cup. As a result, many such players simply give up the game.

It is therefore an overriding object of the present invention to improve upon the prior art by providing a simple apparatus whereby a golf ball may be retrieved from a putting cup without bending downward. Additionally, it is an object of the present invention to provide such an apparatus that is inexpensive to manufacture and convenient to use. It is a further object of the present invention to provide such an apparatus that in no manner interferes with the otherwise ordinary play of the game of golf.

SUMMARY OF THE INVENTION

In accordance with the foregoing objects, the present invention—a golf ball retrieval device—generally comprises an attachment pin, for mating with the end of a golf club grip, and a holder adapted to be removably dependently attached to the attached pin. The holder is generally formed in the shape of hollow hemisphere. Additionally, the holder is preferably manufactured from a polycarbonate or like material in order to enable a slight spreading of two wings formed in the holder between two troughs in the sides of the holder. In this manner, the holder is adapted to apply a slight gripping force about a golf ball inserted into the holder.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
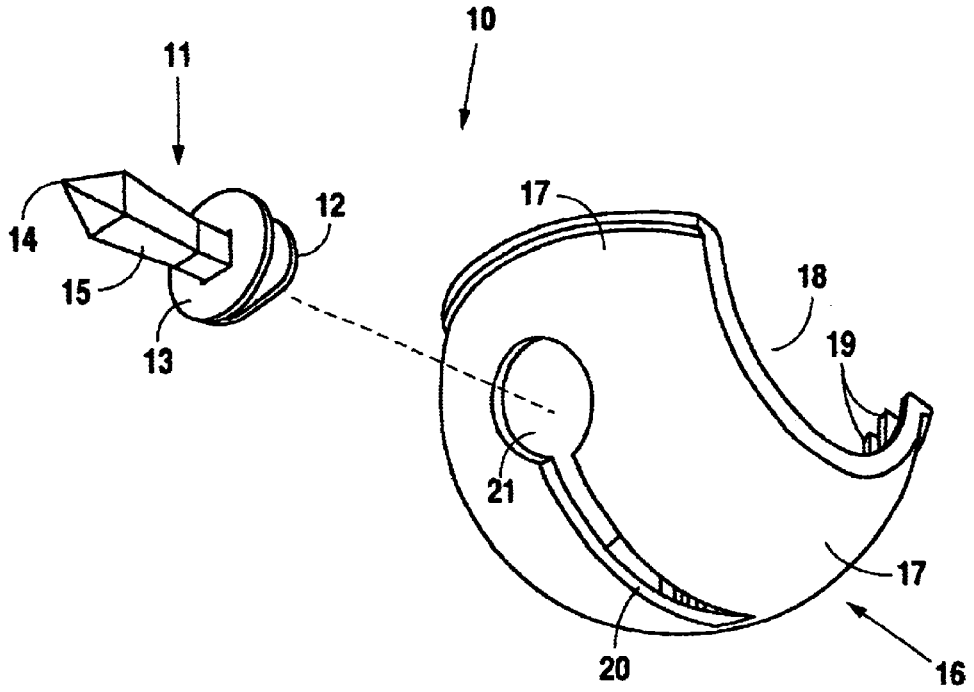
FIG. 1 shows, in an exploded perspective view, the golf ball retrieval device of the present invention.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the preferred embodiment of the golf ball retrieval device 10 of the present invention is shown to generally comprise an attachment pin 11, for mating with the end of a golf club grip 22, and a holder 16 adapted to be removably dependently attached to the attached pin 11. For reasons that will be more apparent further herein, the holder 16 is generally formed in the shape of hollow hemisphere. Additionally, the holder 16 is preferably manufactured from a polycarbonate or like material in order to enable a slight spreading of two wings 17 formed in the holder 16 between two troughs 18 therein (particularly shown in FIGS. 1 through 4). In this manner, the holder 16 is adapted to apply a slight gripping force about a golf ball 23 inserted into the holder 16, as depicted in FIG. 4.

As shown in FIG. 1, the attachment pin 11 may be mated with the holder 16 by insertion of the head 12 of the attachment pin 11 through an aperture 21 provided in the holder 16 and, thereafter, translation of the head 12 into a slot 20 extending from the aperture 21. The golf ball retrieval device 10 may then be secured to the grip 22 of a golf club by pressing the point 14 of the attachment pin 11 into the end of the grip 22. As shown in the figures, a shoulder 13 provided between the head 12 and the point 14 of the attachment pin 11 serves to ensure that the attachment pin 11 is not over-inserted into the grip 22. In this manner, as will be better understood further herein, the holder 16 may be removed from the attachment pin 11 for placement of the golf club into a golf bag. In order to ensure that the attachment pin 11 does not inadvertently detach from the grip 22, a bulge 15 is preferably formed between the shoulder 13 and the point 14 of the attachment pin 11.

Figure 3:
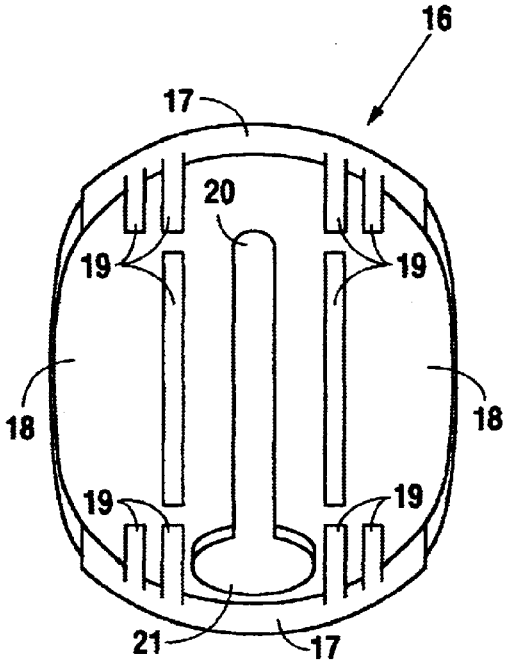
FIG. 3 shows, in a top plan view, details of the holder of the golf ball retrieval device of FIG. 1.
Figure 4:
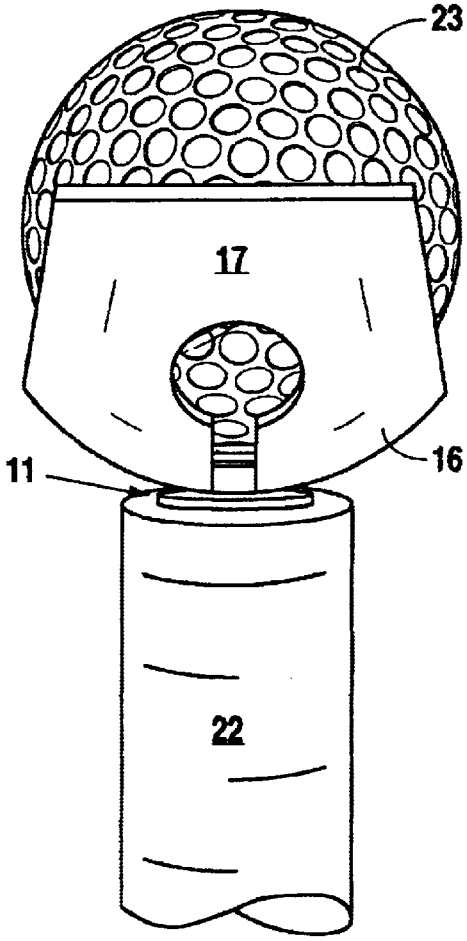
FIG. 4 shows, in an elevational view, the golf ball retrieval device of FIG. 1 as affixed upon the grip of a golf club and employed to hold a golf ball.
Figure 5:
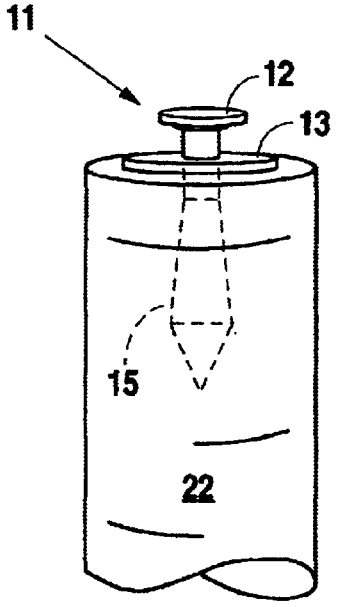
FIG. 5 shows, in an elevational view, the pin of the golf ball retrieval device of FIG. 1 remaining affixed to the grip of a golf club with the holder detached from the pin.

As particularly shown in FIG. 3, the holder 16 preferably comprises a plurality of cleats 19 disposed about the interior walls of the holder 16. As will be apparent to those of ordinary skill in the art, provision of such cleats 19 provides a non-uniform surface, thereby enhancing the grip of the holder 16 about an inserted golf ball 23. While Applicant has found that such elongate cleats 19 as depicted in FIG. 3 are effective in securely gripping the golf ball 23, it is noted that other specific formations such as, for example, a plurality of bumps may be employed as substantial equivalents to the cleats 19.

Figure 2:
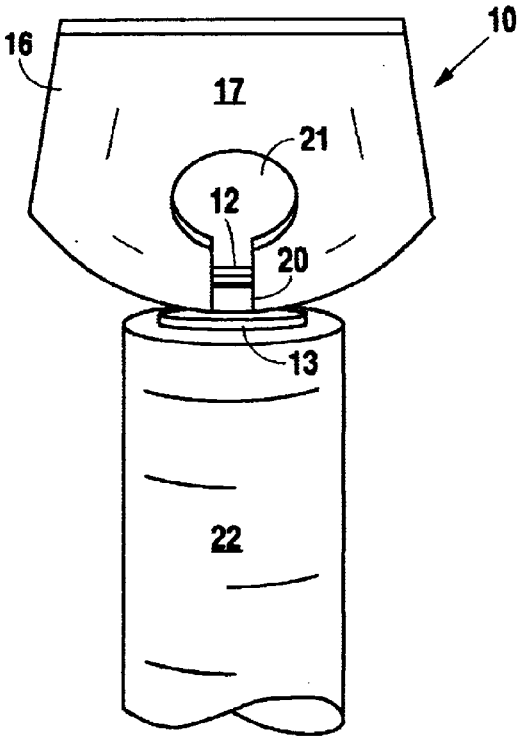
FIG. 2 shows, in an elevational view, the golf ball retrieval device of FIG. 1 as affixed upon the grip of a golf club.

In use, the a golfer inserts the head 12 of the attachment pin 11 through the aperture 21 in the holder 16 and thereafter slides the head 12 into the region of the slot 20 in the holder 16, thereby securing the attachment pin 11 to the holder 16. The assembled golf ball retrieval device 10 is then affixed to a golf club by inserting the point 14 of the attachment pin 11 into the end of the grip 22 of a golf club, as shown in FIG. 2. Utilizing the golf club as a handle, the golfer may then employ the golf ball retrieval device 10 of the present invention to reach into any area, including a putting cup or tall grass, which may harbor dangerous snakes or the like, to retrieve a golf ball 23.

In retrieving a golf ball 23, the golfer presses the wings 17 of the holder 16 against the side of the golf ball 23, causing a slight spreading of the wings 17 one from the other. As the holder 16 is pressed about the golf ball 26, the cleats 19 on the internal face of the holder 16 frictionally engage the golf ball 23, thereby holding the golf ball 23 securely within the holder 16. The golfer may then simply pull the golf ball 23 from the holder 16 and resume play.

For storage, the holder 16 is removed from the attachment pin 11 by rotating the holder 16 such that the head 12 of the attachment pin 11 may be pulled back through the aperture 21. The attachment pin 11 remains secured to the end of the grip 22. Because the holder 16 is removable, however, the gold club may be used for play or may be placed into a golf bag without interference from the golf ball retrieval device 10.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, while it is not critical that the attachment pin 11 be made of the same material as the holder 16, those of ordinary skill in the art will recognize that the attachment pin 11 may be molded of a polycarbonate material as a matter of convenience. In any case, because the scope of the present invention is much broader than any particular embodiment, the foregoing detailed description should not be construed as a limitation of the scope of the present invention, which is limited only by the claims appended hereto.

What is claimed is:

1. An apparatus for retrieving a golf ball from a putting cup, said apparatus comprising:

an attachment pin, said attachment pin having a point for insertion into the end of a golf club grip and a head for detachably receiving a ball holder;

a ball holder, said ball holder being generally hemispherical in shape and having a slot terminating in an aperture through said ball holder; and wherein said slot and said aperture are adapted to receive said head of said pin.

2. The apparatus as recited in claim 1, wherein said ball holder comprises two generally oppositely disposed wings.

3. The apparatus as recited in claim 2, wherein said wings are formed between two troughs formed in said ball holder.

4. The apparatus as recited in claim 1, wherein said ball holder comprises a plurality of wings.

5. The apparatus as recited in claim 4, wherein said ball holder further comprises a raised surface on an interior face thereof.

6. The apparatus as recited in claim 5, wherein said ball holder further comprises a plurality of raised surfaces on an interior face thereof.

7. The apparatus as recited in claim 6, wherein said raised surfaces comprise elongate cleats.

8. The apparatus as recited in claim 6, wherein said raised surfaces comprise bumps.

9. The apparatus as recited in claim 1, wherein said attachment pin comprises a shoulder, said shoulder being offset from said head toward said point.

10. The apparatus as recited in claim 9, wherein said pin further comprises a circumferential bulge between said shoulder and said point.

* * * * *